US007657051B1

(12) United States Patent
Kahoe

(10) Patent No.: US 7,657,051 B1
(45) Date of Patent: Feb. 2, 2010

(54) BASS DRUM SPEAKER

(75) Inventor: Lonnie Joseph Kahoe, Charlotte, NC (US)

(73) Assignee: Buckanear Productions, L.L.C., New Orleans, LA (US)

( * ) Notice: Subject to any disclaimer, the term of this patent is extended or adjusted under 35 U.S.C. 154(b) by 213 days.

(21) Appl. No.: 11/381,928

(22) Filed: May 5, 2006

Related U.S. Application Data

(60) Provisional application No. 60/677,915, filed on May 5, 2005.

(51) Int. Cl.
*H04R 25/00* (2006.01)

(52) U.S. Cl. ..... 381/345; 381/162; 381/386; 84/723

(58) Field of Classification Search ..... 381/56, 381/345, 349, 160, 162; 84/104, 411, DIG. 24, 84/600, 723, 725, 730, 743
See application file for complete search history.

(56) References Cited

U.S. PATENT DOCUMENTS

| | | | | |
|---|---|---|---|---|
| 2,900,453 | A * | 8/1959 | Cammack | 381/355 |
| 3,553,339 | A | 1/1971 | Dominguez | |
| 3,659,032 | A | 4/1972 | May | |
| 4,168,646 | A | 9/1979 | May | |
| 4,570,522 | A | 2/1986 | May | |
| 5,293,000 | A | 3/1994 | Adinolfi | |
| 5,430,245 | A | 7/1995 | Rogers | |
| 6,075,197 | A | 6/2000 | Chan | |
| 6,757,402 | B2 | 6/2004 | Chan | |
| 6,815,602 | B2 | 11/2004 | De Franco | |
| 6,982,376 | B2 * | 1/2006 | Wise | 84/600 |
| 7,256,342 | B2 * | 8/2007 | Hagiwara et al. | 84/726 |
| 7,282,633 | B1 * | 10/2007 | Coolidge | 84/723 |
| 2004/0118269 | A1 | 6/2004 | Yoshino | |
| 2004/0211310 | A1 | 10/2004 | Hagiwara et al. | |
| 2005/0022655 | A1 | 2/2005 | Wise | |
| 2007/0189553 | A1 * | 8/2007 | Holden | 381/99 |

OTHER PUBLICATIONS

Slibtomix Custom Subwoofer Enclosures, www.subtoms.com/index.html and www.subtomix.com, websites.
Subtomix Custom Subwoofer Enclosures Instruction Manual.
Subtomix Custom Subwoofer Enclosures Brochure.

* cited by examiner

*Primary Examiner*—Huyen D Le
(74) *Attorney, Agent, or Firm*—Garvey, Smith, Nehrbass & North, L.L.C.; Seth M. Nehrbass; Charles C. Garvey, Jr.

(57) ABSTRACT

A speaker apparatus includes a generally cylindrically shaped, hollowed case, a drum membrane at a first end of the case; and an electrically powered speaker at a second end of the case. The speaker is preferably positioned to emit sound primarily away from the drum membrane. The drum membrane is preferably tunable, using a plurality of circumferentially positioned drum tuners.

20 Claims, 2 Drawing Sheets

BASS DRUM SPEAKER

CROSS-REFERENCE TO RELATED APPLICATIONS

Priority of my U.S. Provisional Patent Application No. 60/677,915, filed 5 May 2005, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to speakers. More particularly, the present invention relates to an improved powered audio speaker that includes a cylindrically shaped case or housing having a speaker directing most of its sound toward one end of the case and a drum membrane mounted on the other end of the case. The drum membrane is tunable, so that a listener can obtain different sound effects by adjusting or tuning the drum membrane.

2. General Background of the Invention

Drums often have a drum membrane of some sort on one end. They are typically open on the other end.

The following table lists U.S. Patent Documents that are possibly relevant, and incorporated herein by reference.

TABLE

| PAT. NO. | TITLE | ISSUE DATE |
|---|---|---|
| 3,553,339 | Drum-like musical instruments with electrical pickups and circuitry | Jan. 5, 1971 |
| 3,659,032 | Percussion Instrument | Apr. 25, 1972 |
| 4,168,646 | Electro-acoustically amplified drum | Sep. 25, 1979 |
| 4,570,522 | Electro-acoustically amplified drum and mounting bracket | Feb. 18, 1986 |
| 5,293,000 | Electronic percussion system simulating play and response of acoustical drum | Mar. 8, 1994 |
| 5,430,245 | Electroacoustical drum | Jul. 4, 1995 |
| 6,075,197 | Apparatus and method for providing interactive drum lessons | Jun. 13, 2000 |
| 6,757,402 | Knockdown speaker | Jun. 29, 2004 |
| 6,815,602 | Electronic percussion instrument with impact position - dependent variable resistive switch | Nov. 9, 2004 |
| 2004/0118269 | Electronic percussion instrument and vibration detection apparatus | Jun. 24, 2004 |
| 2004/0211310 | Sound pickup device for percussion instrument | Oct. 28, 2004 |
| 2005/0022655 | Real drum trigger monitor and amplified tone module | Feb. 3, 2005 |

Custom hand-built subwoofer enclosures resembling drum shells in appearance are advertised at www.subtoms.com/index.html and at www.subtomix.com (these websites are incorporated herein by reference). The instructions for installing speaker elements in the enclosures include the following general description. "Note: Tightening and loosening tension rods will not tune your enclosure like a drum. Do not over-tighten the tension rods, which can cause damage to the enclosure's shell." This instruction indicates that these enclosures only resemble drum shells in appearance, not in function.

BRIEF SUMMARY OF THE INVENTION

The apparatus of the present invention includes a housing having opposed end portions, one end portion providing a drum membrane (preferably a bass drum membrane), the other end portion being a powered audio speaker having driver and cone portions. The apparatus of the present invention can be made by taking a conventional drum and affixing speaker components to its open end, preferably in an acoustically tight manner.

In a simple form the speaker apparatus includes a substantially cylindrical (preferably cylindrical) housing or case with a drum membrane at one end and a speaker at the other end. The drum membrane can be any suitable material normally used for drums, and preferably for bass drums. The drum membrane is preferably synthetic, plastic, skin, or rubber, though it could also or instead be made of, for example, metal, fiber, wood, or composite. The drum membrane can be any commercially available drum membrane.

The speaker housing or case can be made of conventional drum body materials, such as, for example, wood, kevlar, acrylic, metal, or fiber. The speaker housing or case is preferably made of maple, birch, mahogany, or bubinga. It can have a thickness of, for example, 1-25.4 mm, preferably 4-13 mm, and more preferably around 6-7 mm.

The speaker case can be about one and thirty six (1-36) inches in diameter. Preferably, the speaker case is about 4-28 inches in diameter. More preferably, the speaker case is about eight to twenty four (8-24) inches in diameter. Most preferably, the speaker case is about twelve to eighteen (12-18) inches in diameter.

The speaker case can be about one to thirty six (1-36) inches in length. Preferably, the speaker case is about ten to thirty six (10-36) inches in length. More preferably, the speaker case is about ten to thirty (10-30) inches in length. Most preferably, the speaker case is about eighteen to twenty four (18-24) inches in length. The speaker can be a conventional electrically driven speaker, such as Model No. 421 or 421-8LF Bass Speaker made by Altec Corporation, or speakers made by Sony Corporation or Celestion Corporation. The speaker can also be any speaker sold under the mark Bose®, Peavey®, or JBL®, for example. Preferably, it is a bass speaker, such as Model No. 4156 made by Altec Corporation or B&C Speaker Model No. 10NDL64.

Electrically, the speaker apparatus of the present invention functions as do other audio speakers. Acoustically, however, it has a deeper bass than like speakers without the drum membrane on the other end of the speaker case.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
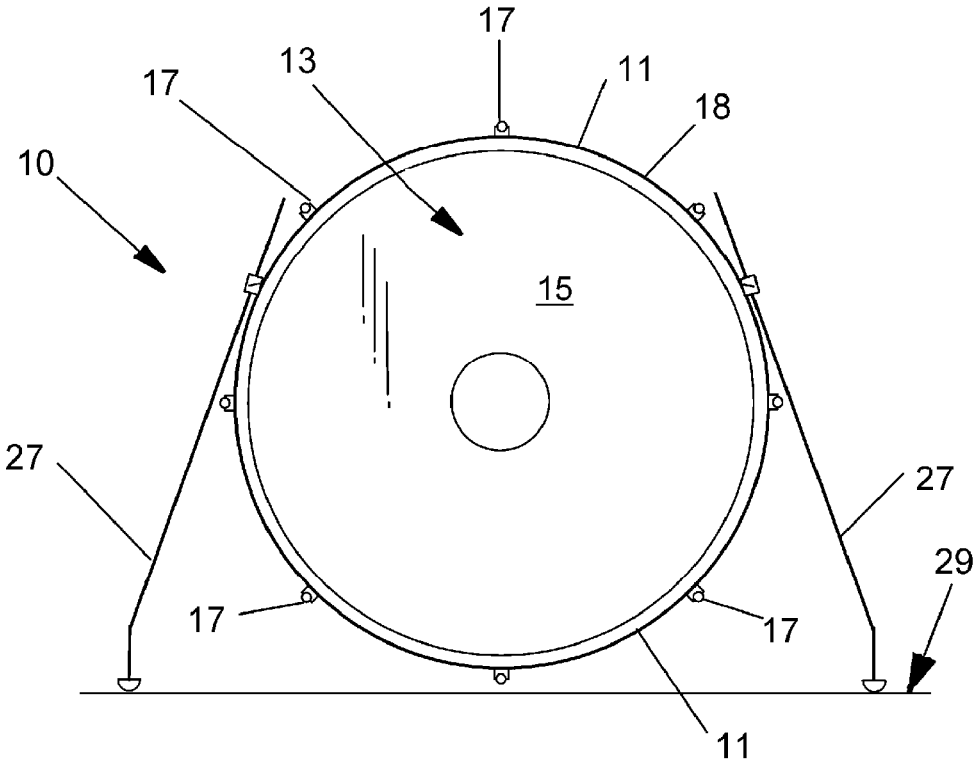
FIG. 1 is a front perspective view of a preferred embodiment of the apparatus of the present invention.

FIGS. 1-4 show a preferred embodiment of the present invention designated generally by the numeral 10. Speaker apparatus 10 provides a speaker case 11 with a drum head 18 on one end 13 and a speaker on the other end 14. Speaker case 11 can be generally cylindrically shaped, having a hollow interior 12, openings at ends 13, 14 and a case wall 19. The speaker case 11 wall 19 is preferably made of 9-ply maple, but it can be made of other conventional or commercially available drum body or like material. In the drawings case 11 can be that of a sixteen inch (16") floor "tom" type drum by Ludwig®.

The drum head 18 is mounted on the speaker case with a metal drum hoop 16, and is tunable with drum tuners 17, tension rods or threaded screws (commercially available e.g. Rhythm Tech IT index tension tuners), for example. The speaker 20, which could be a fifteen inch (15") Altec model 421 eight (8) ohm bass speaker as an example, is shown as being held in place with a wood ring 21 which is glued and/or attached with fasteners (e.g. screws, rivets, or the like) to the speaker case 11. Also, one could use a twelve inch (12") drum with a ten inch (10") speaker 20, for example. The tuneability and flex of the drum head 18 increase sound, giving more harmonic range per decibel per watt added by tonal acoustics of the case 11.

Figure 2:
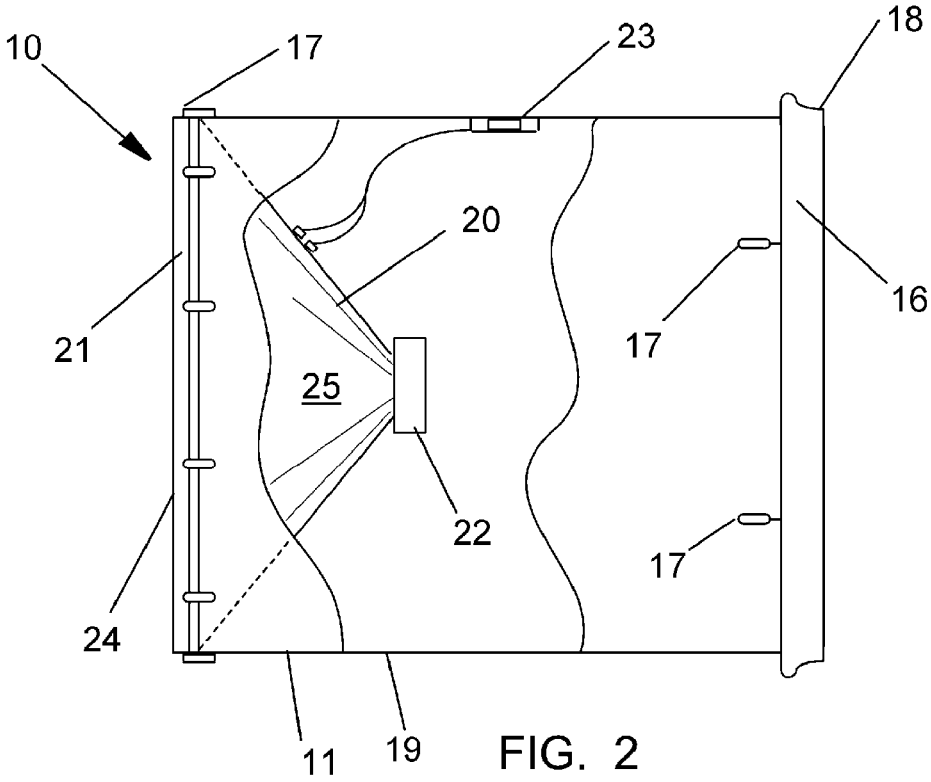
FIG. 2 is a side, partially cut-away view of the embodiment of the apparatus of the present invention.
Figure 3:
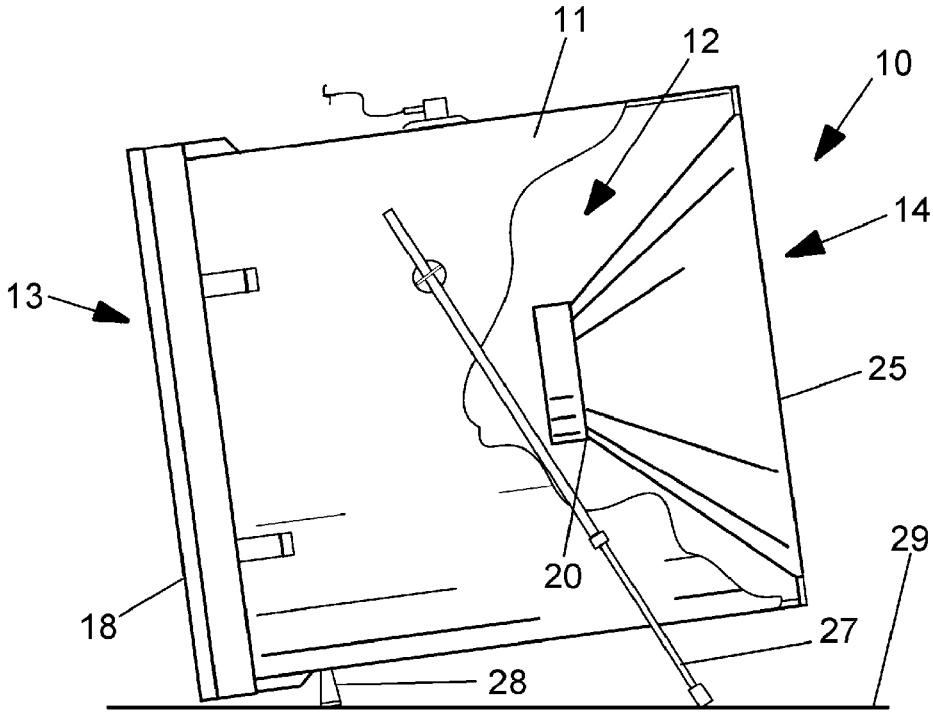
FIG. 3 is a side, partially cut-away view of the embodiment of the apparatus of the present invention.

A plug input 23 is included in the speaker case 11 (in the wall 19 as shown in FIGS. 2 and 3) to connect the speaker apparatus 20 to an electrical signal to drive the speaker. Because sound is round, a cylindrical case 11 is used, and drum sizes will range from ten inches (10") to twenty eight inches (28") in diameter. Length will vary per individual needs and styles of music intended.

Standard drum shells are constructed of 8-ply maple. The speaker case 11 of the present invention can be 6 or 10 ply if desired. The material is not limited to maple, but could also be birch, mahogany, bibunga, walnut or the like. The material for case 11 is not limited to hardwoods, but could be acrylic composite shells available in any color of the spectrum including mixing colors in patterns. The material for the case 11 could be carbon fibre as well as precious and semi-precious metals.

Drum heads 18 are available in various styles, depending on application and style of music. Head 18 can be commercially available from Remo®, Aquarian® and EVANS®, each company offering a wide range of head types.

Speaker covering heads can be custom made with a choice of colored cloths or various styles of metal mesh for appearance as well as protection for the enclosed speaker.

Figure 4:
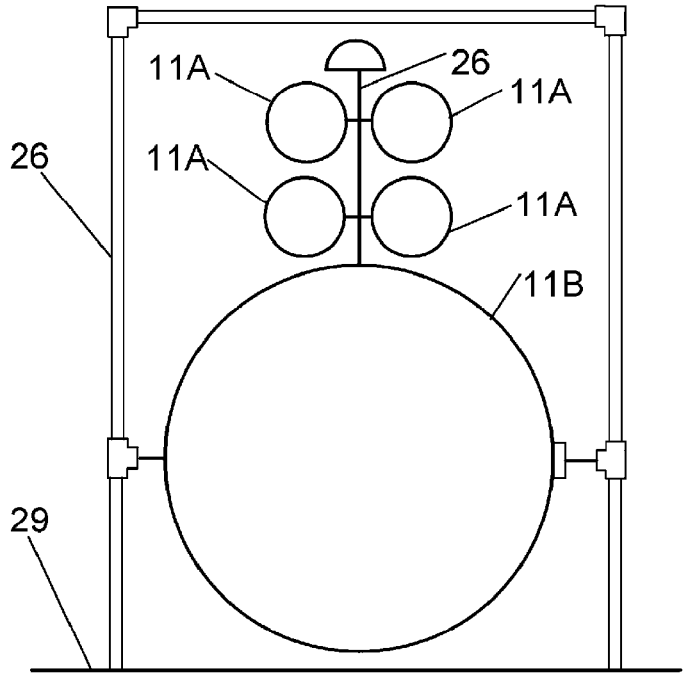
FIG. 4 is a side view of the embodiment of the apparatus of the present invention.

Typically, the speakers 20 will range in size from between about eight and eighteen inches (8" to 18"). The speaker 20 can be Altec Lansing, but not limited to such manufacturer. Speaker 20 cone 25 opens toward a second end portion 14 of case 11 (see FIG. 3). A full-rig could be as shown in FIG. 4, which depicts four twelve inch (12") cases 11A with ten inch (10") speakers, one eighteen inch (18") case 11B with a fifteen inch (15") speaker suspended within a pipe structure 26 (e.g. aluminum) and preferably mounted with custom hardware. Drum hardware such as drum tuners 17 or lugs, tension rods, and hoops 16 can be in many different styles and colors including but not limited to chrome, powder coating, brass or the like. Case 11 can be fitted with legs 27 and/or feet 28 for supporting case 11 in a selected orientation relative to an underlying support surface 29 (e.g. floor).

The following is a list of parts and materials suitable for use in the present invention.

PARTS LIST

| Part Number | Description |
|---|---|
| 10 | drum speaker apparatus |
| 11 | case |
| 11A | case (smaller) |
| 11B | case (larger) |
| 12 | hollow interior |
| 13 | end |
| 14 | end |
| 15 | drum membrane |
| 16 | drum hoop |
| 17 | drum tuner or tension rod |
| 18 | drum head |
| 19 | case wall |
| 20 | speaker |
| 21 | wood ring |
| 22 | magnet |
| 23 | plug input |
| 24 | speaker covering |
| 25 | cone |
| 26 | pipe structure |
| 27 | leg |
| 28 | foot |
| 29 | underlying surface |

All measurements disclosed herein are at standard temperature and pressure, at sea level on earth, unless indicated otherwise.

The foregoing embodiments are presented by way of example only; the scope of the present invention is to be limited only by the following claims.

The invention claimed is:

1. A speaker apparatus comprising:

a) a generally cylindrical case having a case wall, a hollow interior, and first and second open end portions;

b) a tunable drum membrane fitted to the case at the first end portion, the membrane closing the first open end portion of the case at a first end portion; and c) an electrically powered speaker apparatus mounted in the case at the second end portion of the case, the speaker apparatus including a driver and being positioned to generate sound that emits from the case via the second open end portion and in a first direction away from the drum membrane and in a second direction toward the drum membrane, the electrically powered speaker apparatus being mounted to the second end portion of the case in an acoustically tight manner.

2. The speaker apparatus of claim 1, further comprising a plug input in the wall of the speaker case for receiving an electrical signal for driving the speaker driver.

3. The speaker apparatus of claim 1, wherein the drum membrane is of a material selected from the group that includes plastic, skin, rubber, metal.

4. The speaker apparatus of claim 1, wherein the case is of a material selected from the group that includes wood, Kevlar®, acrylic, metal, composite material, fiber containing material.

5. The speaker apparatus of claim 1, wherein the case supports drum tuners that enable the drum membrane to be tuned.

6. The speaker apparatus of claim 1, wherein the speaker driver includes a magnet.

7. The speaker apparatus of claim 1, wherein the speaker includes a cone.

8. The speaker apparatus of claim 7, wherein the cone opens toward the second end portion of the case.

9. A speaker apparatus comprising:

a) a generally cylindrical case having a case wall, a hollow interior, and first and second open end portions;

b) a drum membrane fitted to the case at the first end portion, the membrane closing the first open end portion of the case at a first end portion; and c) an electrically powered woofer speaker mounted in the case at the second end portion of the case, the woofer speaker apparatus including a driver and being positioned to generate sound that emits from the case via the second open end portion, the electrically powered woofer speaker being mounted to the second end portion of the case in an acoustically tight manner.

10. The speaker apparatus of claim 9, further comprising a plug input in the wall of the speaker case for receiving an electrical signal for driving the speaker driver.

11. The speaker apparatus of claim 9, wherein the drum membrane is of a material selected from the group that includes plastic, skin, rubber, metal, wood, composite material.

12. The speaker apparatus of claim 9, wherein the case is of a material selected from the group that includes wood, Kevlar®, acrylic, metal, composite material, fiber containing material.

13. The speaker apparatus of claim 9, further comprising drum tuners that enable the drum membrane to be tuned.

14. The speaker apparatus of claim 9, wherein the speaker driver includes a magnet.

15. The speaker apparatus of claim 9, wherein the speaker includes a cone.

16. The speaker apparatus of claim 9, wherein the cone opens toward the second end portion of the case.

17. The speaker apparatus of claim 9, further comprising legs for holding the case in a selected orientation relative to an underlying support surface.

18. The speaker apparatus of claim 9, further comprising a support frame, multiple of said speaker apparatus, said multiple speaker apparatus being supported by the support frame at multiple spaced apart positions.

19. The speaker apparatus of claim 18, wherein the frame supports the speaker apparatus at different elevations.

20. The speaker apparatus of claim 18, wherein said multiple speaker apparatus include at least one of a larger diameter and at least one of a smaller diameter.

* * * * *